US010570928B2

(12) United States Patent
Cocks

(10) Patent No.: US 10,570,928 B2
(45) Date of Patent: Feb. 25, 2020

(54) CENTRIFUGAL BLOWER ASSEMBLY AND METHOD FOR ASSEMBLING THE SAME

(71) Applicant: Regal Beloit America, Inc., Beloit, WI (US)

(72) Inventor: Rachele Barbara Cocks, Columbia City, IN (US)

(73) Assignee: Regal Beloit America, Inc., Beloit, WI (US)

( * ) Notice: Subject to any disclaimer, the term of this patent is extended or adjusted under 35 U.S.C. 154(b) by 795 days.

(21) Appl. No.: 13/841,918

(22) Filed: Mar. 15, 2013

(65) Prior Publication Data

US 2014/0271133 A1 Sep. 18, 2014

(51) Int. Cl.

| | |
|---|---|
| ***F04D 29/66*** | (2006.01) |
| ***F04D 29/42*** | (2006.01) |
| ***F04D 29/44*** | (2006.01) |
| ***F04D 29/40*** | (2006.01) |
| ***F04D 17/16*** | (2006.01) |

(52) U.S. Cl.

CPC ..... *F04D 29/667* (2013.01); *F04D 17/16* (2013.01); *F04D 29/403* (2013.01); *F04D 29/4226* (2013.01); *F04D 29/441* (2013.01); *F04D 29/444* (2013.01)

(58) Field of Classification Search

CPC ..... F04D 29/40; F04D 29/403; F04D 29/42; F04D 29/4206; F04D 29/4226; F04D 29/44; F04D 29/441; F04D 29/661; F04D 29/667; F04D 29/444

See application file for complete search history.

(56) References Cited

U.S. PATENT DOCUMENTS

| | | | | |
|---|---|---|---|---|
| 3,469,772 | A * | 9/1969 | McDonald | F04D 17/162 415/198.1 |
| 4,712,611 | A | 12/1987 | Witzel | |
| 4,844,695 | A * | 7/1989 | Banks | F04D 29/462 415/161 |
| 4,991,646 | A | 2/1991 | Spears | |
| 5,399,068 | A * | 3/1995 | Park | F04D 29/444 415/204 |
| 5,489,186 | A | 2/1996 | Yapp et al. | |
| 5,998,246 | A | 12/1999 | Huang et al. | |
| 6,146,092 | A | 11/2000 | Botros et al. | |

(Continued)

OTHER PUBLICATIONS

China First Office Action for related Application No. 201410099197.9, dated May 3, 2017, 9 pages.

*Primary Examiner* — Bryan M Lettman

(74) *Attorney, Agent, or Firm* — Armstrong Teasdale LLP

(57) ABSTRACT

A centrifugal blower assembly comprises a scroll wall and a pair of opposing sidewalls. The scroll wall is positioned between the pair of opposing sidewalls such that the scroll wall and opposing sidewalls together define a blower chamber and a blower outlet. A baffle element is positioned within the blower chamber and adjacent the blower outlet such that the baffle element is configured to facilitate uniform distribution of airflow downstream of the blower assembly. An air stream splitter is coupled to the scroll wall. The air stream splitter includes a spline member extending a varying distance from the scroll wall. The air stream splitter is positioned within the blower chamber to facilitate uniform airflow distribution within the blower assembly.

20 Claims, 9 Drawing Sheets

(56) References Cited

U.S. PATENT DOCUMENTS

| | | | | |
|---|---|---|---|---|
| 6,575,696 | B1 | 6/2003 | Lyons et al. | |
| 7,357,621 | B2 | 4/2008 | Hustvedt et al. | |
| 8,109,718 | B2 * | 2/2012 | Hwang | F04D 25/0613 361/679.48 |
| 8,197,203 | B2 | 6/2012 | Jairazbhoy et al. | |
| 9,157,441 | B2 * | 10/2015 | Dickinson | F04D 25/0606 |
| 2009/0145583 | A1 * | 6/2009 | Han | F04D 29/282 165/121 |
| 2011/0232282 | A1 * | 9/2011 | Anschel | F01D 9/026 60/615 |
| 2012/0034077 | A1 * | 2/2012 | Jairazbhoy | F04D 29/4226 415/203 |
| 2012/0036849 | A1 * | 2/2012 | Watson | F01D 17/141 60/611 |

* cited by examiner

CENTRIFUGAL BLOWER ASSEMBLY AND METHOD FOR ASSEMBLING THE SAME

BACKGROUND

The field of the disclosure relates generally to a housing for a centrifugal fan, and more specifically, to methods and apparatus for uniform airflow distribution within a centrifugal fan.

Centrifugal fans or blowers are commonly used in the automotive, air handling and ventilation industries for directing large volumes of forced air, over a wide range of pressures, through a variety of air conditioning components. In a known centrifugal blower, air is drawn into a housing through one or more inlet openings by a rotating wheel. This air is then forced around the housing and out an outlet end. Known centrifugal blowers generate a high speed, non-uniform airflow that may produce undesirable whistling, tonal noise, or broadband noise as air travels through the blower housing. This noise may be caused by pressure changes within the airflow generated by portions of the airflow at different pressures interacting with each other or with a portion of the blower. The pressure variances in known blowers may be caused by turbulence in the airflow or airflow recirculation.

In at least some known centrifugal blowers, airflow recirculation may be caused by the mixing of an airflow entering the blower in an axial direction that is parallel to the axis of rotation of the blower wheel and the airflow within the blower that flows in a radial direction perpendicular to the same axis. Recirculating airflow generally has a swirling component that may generate undesirable flow structures, such as eddies or vortices, within the airflow. These vortices, in combination with the swirling recirculating flow, cause a non-uniform airflow within the blower housing and at the blower outlet that generates undesirable noise and facilitates inefficient operation of the centrifugal blower.

Moreover, as the airflow is exhausted from known blowers and enters a downstream conditioning component, it continues in the generally circumferential path it followed while inside the blower and tends to impact the sides of the downstream component, causing further undesirable noise and losses in the airflow. Additionally, the impact of the airflow on the component creates undesirable flow structures downstream of the blower that has an undesirable affect in upstream blower performance.

BRIEF DESCRIPTION

In one aspect, a centrifugal blower assembly is provided. The centrifugal blower assembly comprises a scroll wall and a pair of opposing sidewalls. The scroll wall is positioned between the pair of opposing sidewalls such that the scroll wall and opposing sidewalls define a blower chamber and a blower outlet. A baffle element is positioned within the blower chamber and adjacent the blower outlet. The blower assembly further comprises an air stream splitter coupled to the scroll wall. The air stream splitter includes a spline member extending a varying distance from the scroll wall. The air stream splitter is positioned to facilitate uniform airflow distribution within the blower assembly.

In another aspect, an air stream splitter for use in a centrifugal blower assembly is provided. The air stream splitter comprises a spline member coupled to a scroll wall of the blower assembly. The spline member extends a varying distance from the scroll wall. The spline member is perpendicular to the scroll wall and is positioned to facilitate uniform airflow distribution within the blower assembly.

In yet another aspect, a method of assembling a centrifugal blower assembly is provided. The method comprises positioning a scroll wall between a pair of opposing side walls to define a blower chamber and a blower outlet. A baffle element is positioned within the blower chamber and adjacent the blower outlet such that the baffle element is configured to facilitate uniform distribution of airflow downstream of the blower assembly. An air stream splitter is coupled to the scroll wall at a pre-determined location within the blower chamber to facilitate uniform airflow distribution within the blower assembly. The air stream splitter includes a spline member that extends a varying distance from the scroll wall.

DETAILED DESCRIPTION

Figure 1:
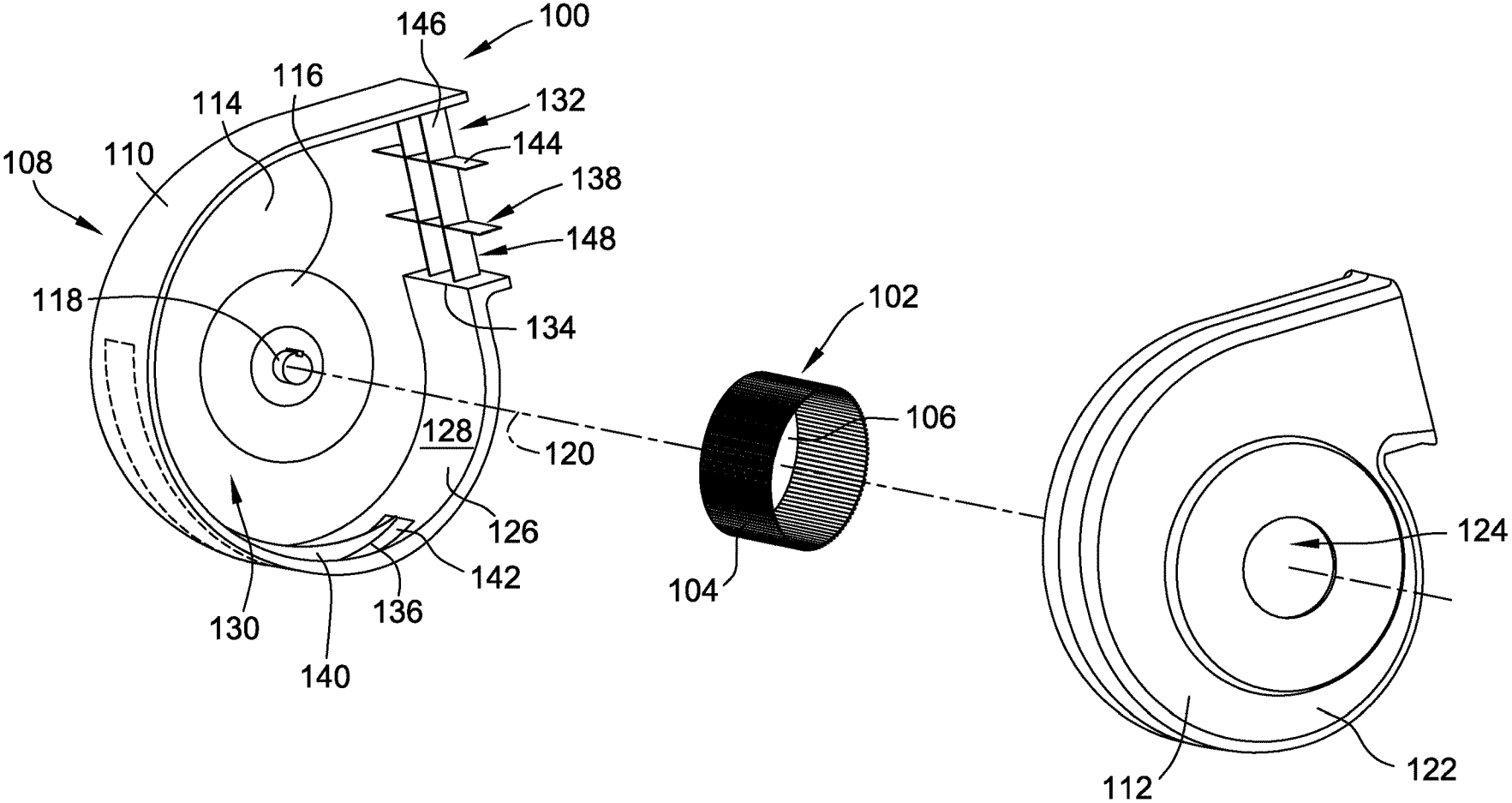
FIG. 1 is an exploded perspective view of an exemplary blower assembly.

The embodiments described herein relate to a centrifugal fan housing. More specifically, embodiments relate to a centrifugal fan housing that uniformly distributes airflow within the housing and at the exit of the housing. FIG. 1 illustrates an exemplary embodiment of a centrifugal blower assembly 100. Blower assembly 100 includes at least one wheel 102 that includes a plurality of fan blades 104 positioned circumferentially about wheel 102. Wheel 102 is further coupled to a wheel hub 106. Blower 100 further includes a housing 108 comprising a rear portion 110 and a front portion 112. Rear portion 110 includes a sidewall 114 through which a motor 116 is inserted. Motor 116 includes a shaft 118 that engages hub 106 to facilitate rotation of wheel 102 about an axis 120. Front portion 112 of housing 108 also includes a sidewall 122 having an inlet 124 through which a volume of air is drawn by wheel 102 to provide air to blower assembly 100. Moreover, blower 100 includes a scroll wall 126 having an interior surface 128, wherein scroll wall 126 defines a blower circumference and is positioned between sidewall 114 and sidewall 122. As such, scroll wall 126, sidewall 114, and sidewall 122 together define a blower chamber 130 and an outlet 132 through which an air stream is exhausted downstream of blower assembly 100. Scroll wall 126 extends circumferentially from a cut-off point 134 about housing chamber 130 to outlet 132. Although blower assembly 100 is illustrated as having only one inlet, outlet, and wheel, blower assembly 100 may include any number of inlets, outlets, and wheels.

Scroll wall 126 is positioned progressively further from wheel 102 in the direction of rotation to accommodate the growing volume of air due to the scroll shape of chamber 130. Rotation of wheel 102 facilitates drawing air through inlet 124, passing it around blower chamber 130, and exhausting it through outlet 132. In the exemplary embodiment, blower assembly 100 includes a single wheel 102 and inlet 124, alternatively, blower assembly 100 may include more than one wheel and/or inlet.

In the exemplary embodiment, blower assembly 100 includes an air stream splitter 136 and an outlet baffle element 138. Alternatively, blower assembly 100 may include more than one splitter 136 and/or more than one baffle element 138. Generally, blower assembly 100 includes any number of splitters 136 and baffles 138 to facilitate operation of blower assembly 100 as described herein. Each splitter 136 is arcuate in shape and includes at least one spline member 140 that is parallel to sidewalls 114 and 122 and that extends a varying distance perpendicularly from scroll wall 126. Alternatively, splitter spline member 140 may extend perpendicularly from a base member 142. In embodiments having base member 142, base member 142 includes a minimum thickness to prevent disrupting the airflow within chamber 130. Further, base member 142 has a substantially elliptical shape. However, base member 142 may have any shape that facilitates operating blower assembly 100 as described herein. In the exemplary embodiment, splitter 136 is coupled to scroll wall 126. Alternatively, splitter 136 may be formed integrally with scroll wall 126. Splitter 136 may include any number of spline members 140 for blower assembly 100 to operate as described herein. In the exemplary embodiment, baffle 138 is coupled within blower chamber 130 adjacent outlet 132 and includes at least one horizontal member 144 and at least one vertical member 146 that define a plurality of openings 148 at blower outlet 132. Splitter 136 and baffle 138 may be used simultaneously or independently to prevent undesirable flow structures such as eddies, swirling, and/or turbulence to reduce noise production and increase blower 100 efficiency. Specifically, splitter 136 is configured to prevent recirculation such that the air has a uniform airflow distribution within chamber 130 and to prevent pressure pulses caused by mixing of volumes of air having a higher pressure and a lower pressure. Additionally, baffle 138 is configured to turn the flow of air exiting blower housing 108 to facilitate uniform flow downstream of blower 100. As used herein "undesirable flow structures" is used to designated flow structures, such as recirculation, vorticies, turbulence, and eddies, in an airflow that have negative effects on blower assembly 100 operation.

Figure 2:
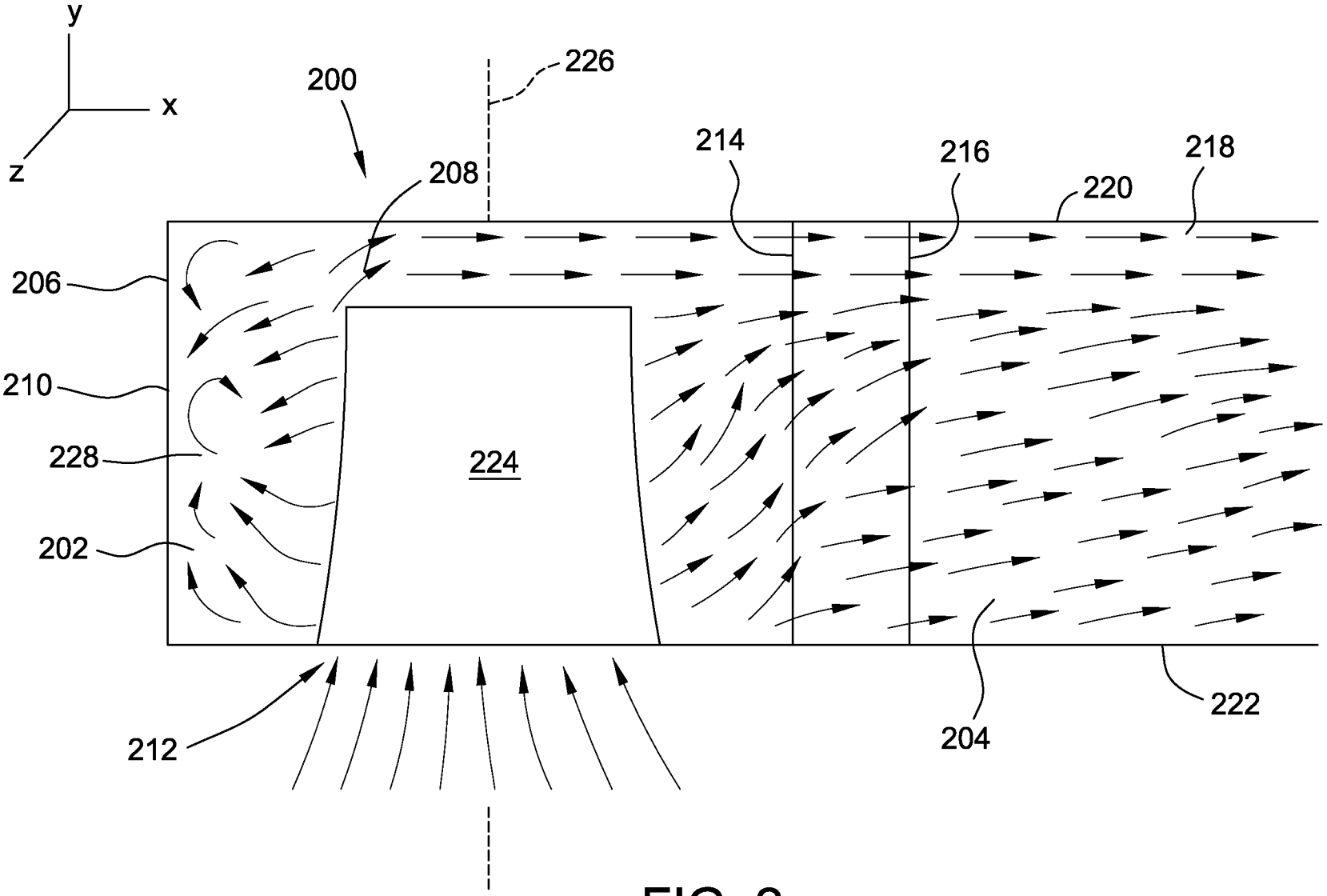
FIG. 2 is a top cross-sectional view of an untreated blower assembly in operation illustrating an air stream direction.
Figure 3:
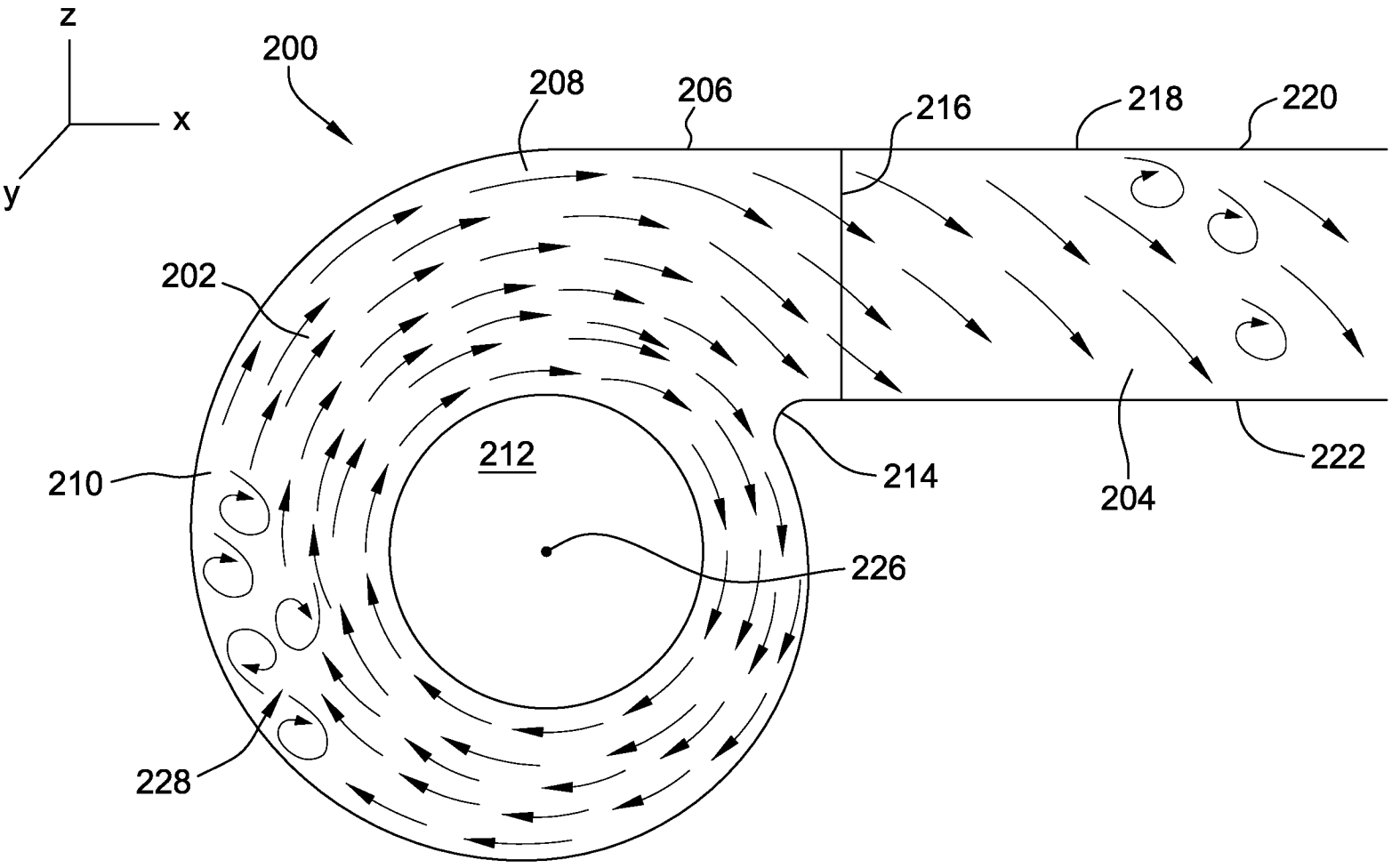
FIG. 3 is a side cross-sectional view of the untreated blower assembly and air stream shown in FIG. 2.

FIG. 2 is a top cross-sectional view of an untreated blower assembly 200 in operation illustrating a first air stream 202 and a second air stream 204. FIG. 3 is a side cross-sectional view of blower assembly 200 and air streams 204 and 202 as shown in FIG. 2. Blower 200 is substantially similar to blower 100 except that blower 200 does not include splitter 136 nor baffle 138. As such, blower 200 includes a housing 206 that defines a blower chamber 208. Housing 206 includes a scroll wall 210, an inlet 212, a cut-off 214, and an outlet 216. Blower 200 is coupled to a duct 218 that receives air stream 202 being channeled out of blower 200 through outlet 216. Duct 218 is downstream of blower 200 and includes a first sidewall 220 and a second sidewall 222. Blower 200 defines two distinct air streams (shown by arrows). First air stream 202 is defined within blower 200 and second air stream 204 is defined within duct 218.

In operation, a blower wheel 224 rotates about an axis 226 of rotation to pull air into housing 206 through inlet 212. The amount of air moved by blower 200 increases as a point on wheel 224 moves within housing 206 from cut-off 214 toward outlet 216. Scroll wall 210 is positioned progressively further from wheel 224 in the direction of rotation to accommodate the growing volume of air due to the scroll shape of chamber 208. Wheel 224 produces first stream 202 of high velocity air which is exhausted from outlet 216 into duct 218. Sidewalls 220 and 222 contain second air stream 204 within duct 218. Wheel 224 draws stream 202 into blower 200 through inlet 212 in the axial direction (referring to wheel axis 226) and turns high velocity first stream 202 to a generally radial direction (referring to a radial direction defined by axis 226). The rapid change in direction of first stream 202 causes differences in stream 202 velocity and pressure between the portion of first stream 202 flowing through inlet 216 and the portion within chamber 208. These differences in pressure and velocity cause a portion of first stream 202 to recirculate behind wheel 224 in a recirculation area 228 and form unfavorable flow structures.

Recirculation is caused by a high pressure portion of first stream 202 flowing behind wheel 224 to a low pressure portion of first stream 202. Different pressures within recirculation area 228 create downstream disturbances such as buffeting that cause blower 200 to operate inefficiently and produces undesired noise. In severe cases, the portion of first stream 202 within recirculation area 228 may buildup and cause air to spill out of inlet 212 and exit blower 200. Further, first stream 202 generally has a swirling component of velocity within recirculation area 228 that re-enters wheel 224 at a different angle than that of air being drawn through inlet 212. The re-entry of air into wheel 224 from recirculation area 228 increases turbulence and flow disturbances, which causes undesired noise and flow non-uniformities that cause undesirable tones and blower 100 inefficiency.

As first stream 202 exits blower 200 through outlet 216 and enters duct 218, first stream 202 transitions into second stream 204. Second stream 204 continues along a circumferential (tangent to a circle swept by rotating wheel 224) path within duct 218 and impacts second sidewall 222. Impacting second sidewall 222 forms eddies adjacent second sidewall 222 in second stream 204, which create turbulence and unfavorable flow structures. Consequently, the circumferential path of second stream 204 causes separation of second stream 204 from first sidewall 220, which forms eddies adjacent first side wall 220. Similarly, eddies formed in second stream 204 adjacent first side wall 220 also cause turbulence and unfavorable flow structures in second stream 204. The turbulence created by eddies in second stream 204 cause blower 200 to operate inefficiently and produces undesired noise downstream of blower 200. Improved air flow distribution within chamber 208 and at outlet 216 prevents recirculation of air within chamber 208 and formation of eddies downstream of outlet 216. Eliminating air flow recirculation and straightening the flow of air at outlet 216 leads to improved blower operating efficiency and a reduction in undesirable noise.

Figure 4:
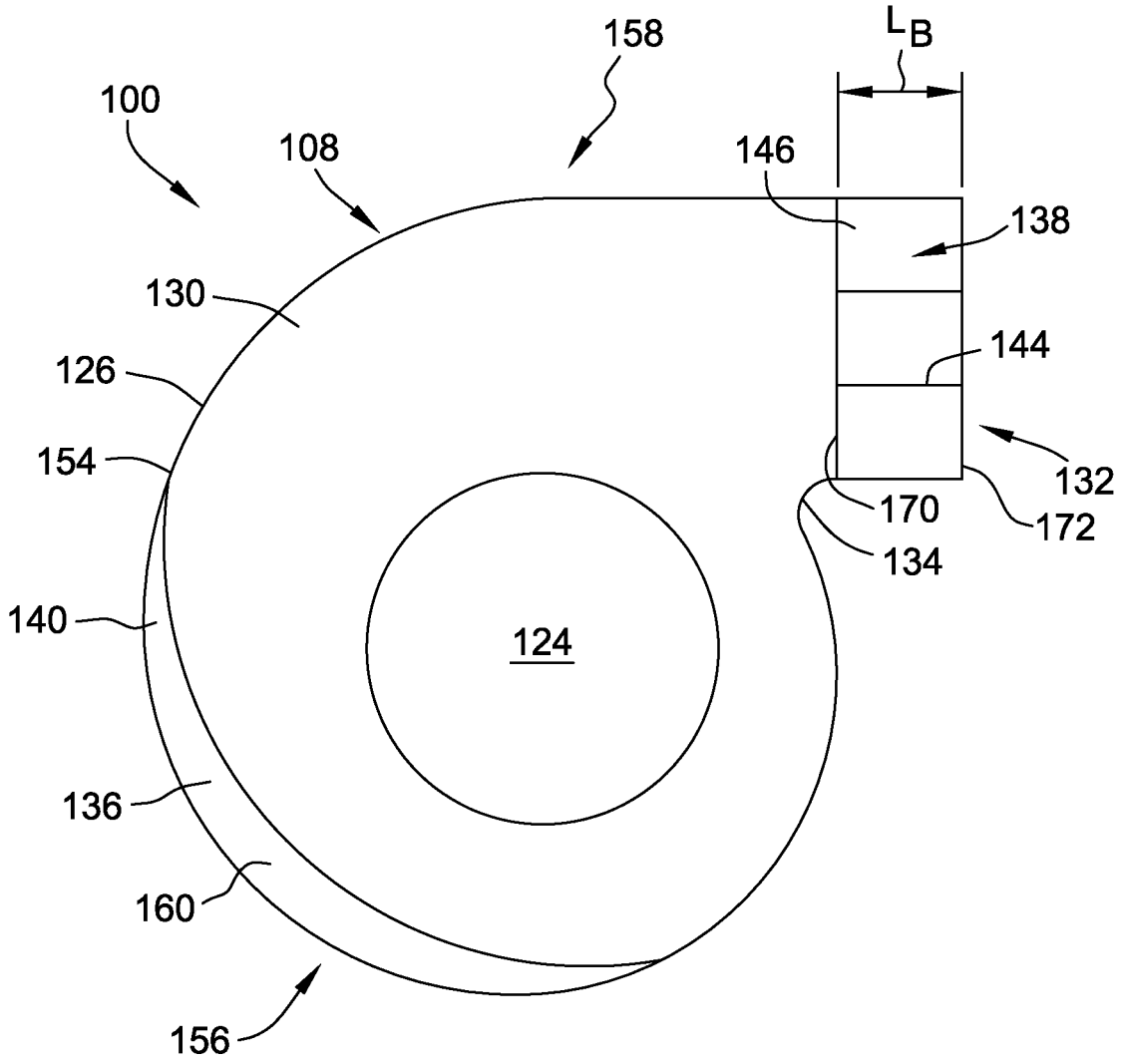
FIG. 4 is a side view of the blower assembly shown in FIG. 1.
Figure 5:
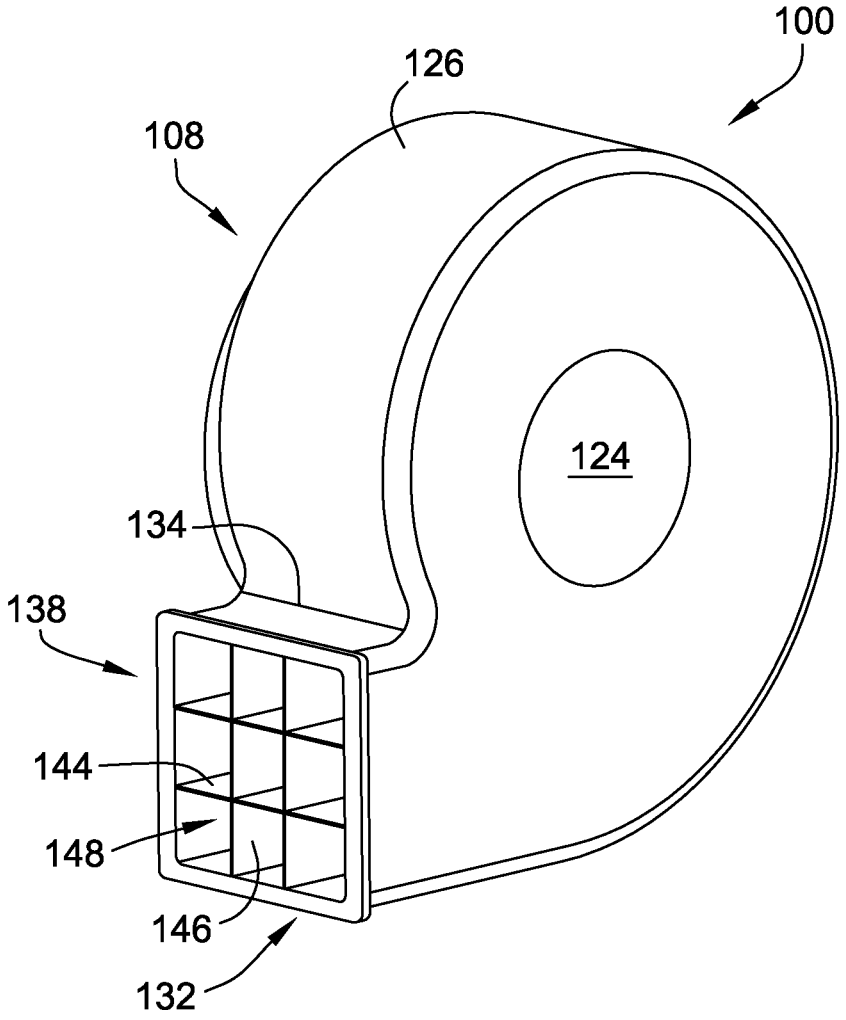
FIG. 5 is a perspective view of the blower assembly shown in FIG. 1.
Figure 6:
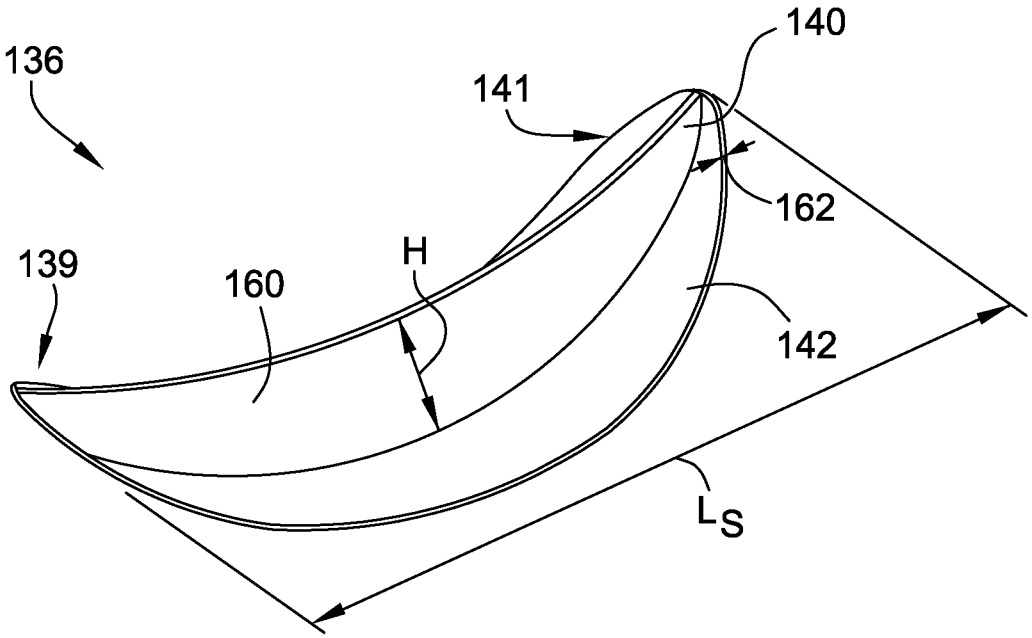
FIG. 6 is perspective view of an exemplary air stream splitter.
Figure 7:
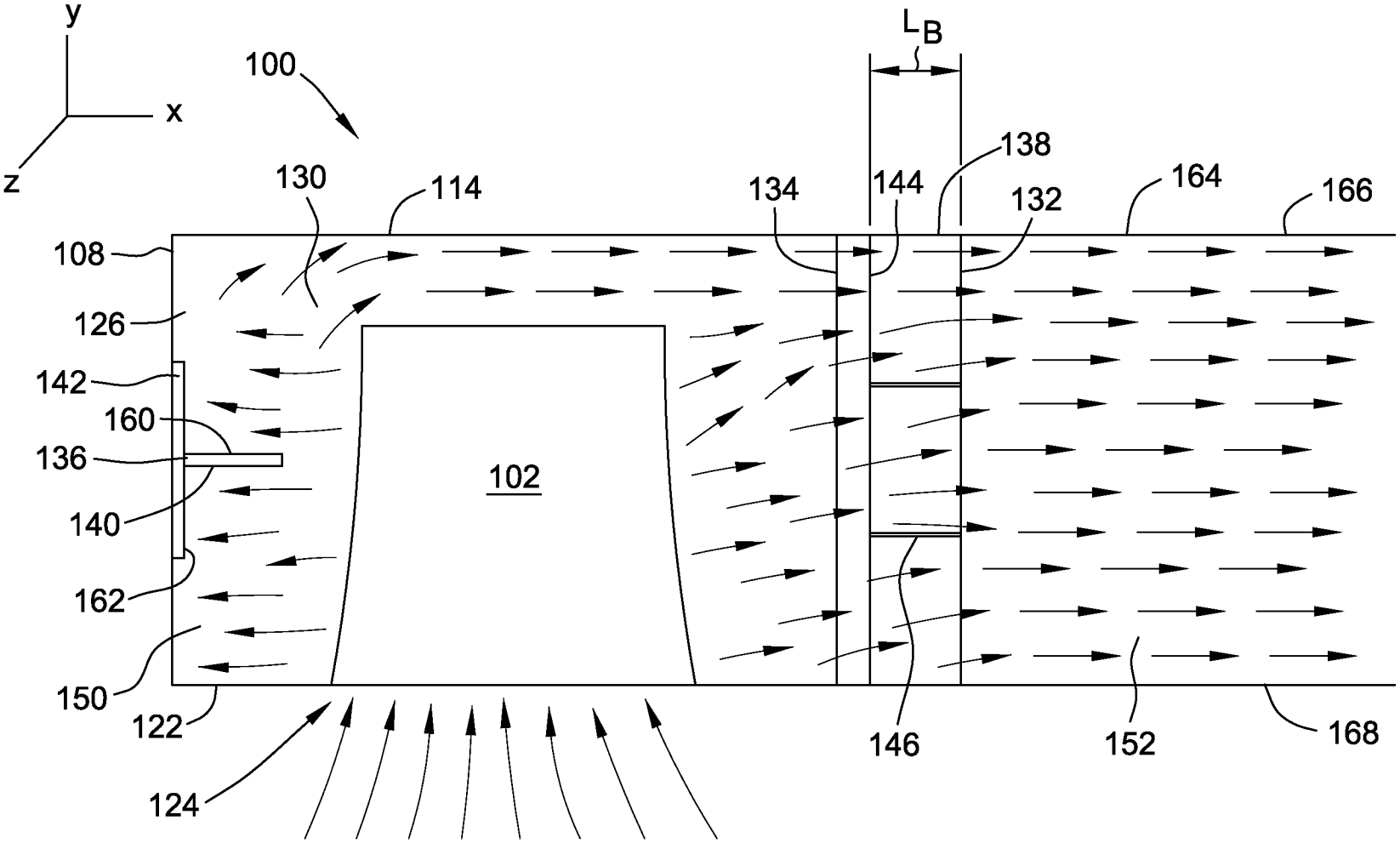
FIG. 7 is a top cross-sectional view of the exemplary blower assembly in operation illustrating an air stream direction and the exemplary air stream splitter.
Figure 8:
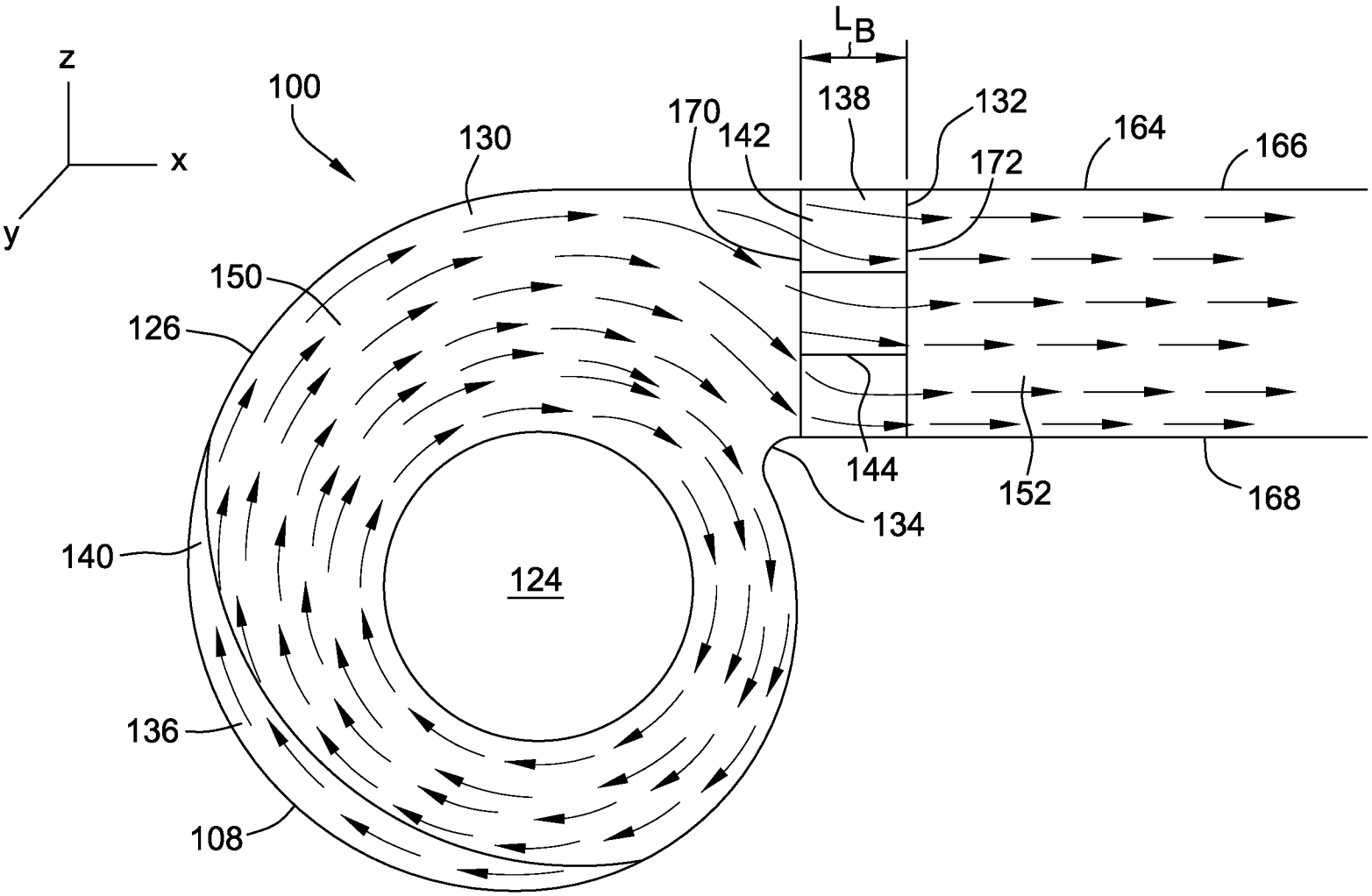
FIG. 8 is a side cross-sectional view of the exemplary blower assembly in operation illustrating an air stream direction.

FIG. 4 is a side view of the exemplary blower assembly shown in FIG. 1 illustrating splitter 136 within chamber 130 and baffle 138 at outlet 132. FIG. 5 is a perspective view of blower assembly 100 shown in FIG. 1 illustrating baffle 138, and FIG. 6 is perspective view of splitter 136. FIG. 7 is a top cross-sectional view of blower assembly 100 in operation illustrating a first air stream 150 and a second air stream 152. FIG. 8 is a side cross-sectional view illustrating blower assembly 100 and air streams 150 and 152. In the exemplary embodiment, splitter 136 is configured to be coupled within chamber 130 of blower 100, as described above. Generally, splitter 136 is configured to prevent recirculation mixing and to evenly distribute stream 150 within blower 100 to prevent efficiency losses and noise generation due to recirculation. Specifically, splitter 136 directs stream 150 along surface 128 (shown in FIG. 1) of scroll wall 126 to prevent a buildup of recirculating air behind wheel 102 as shown in FIGS. 2 and 3.

In the exemplary embodiment, cut-off 134 and a point 154 (shown in FIG. 4) directly across blower 100 from cut-off 134 divide housing 206 into two substantially equal portions, a bottom portion 156 and a top portion 158. In the exemplary embodiment, splitter 136 is configured to be coupled within at least one of bottom portion 156 and/or top portion 158 of housing 206 at a pre-determined location based on blower assembly 100 operation. In the exemplary embodiment, splitter 136 is coupled within bottom portion 156 and includes a pre-determined length $L_s$ (shown in FIG. 6) that extends at least a portion of the distance between point 154 and cut-off 134. For example, in one embodiment, splitter 136 extends approximately one quarter of the way along a circumference of blower assembly 100. Alternatively, length $L_s$ of splitter 136 may extend between point 154 and cut-off 134 such that splitter 136 extends the full arcuate length of bottom portion 156 along wall 126. That is, for example, splitter 136 extends approximately halfway around the circumference of blower assembly 100. However, if length $L_s$ is too long, then the size of the boundary layer (not shown) that is formed on spline member 140 may increase. Growth of the boundary layer on splitter 136 increases the viscosity of stream 150 and may cause undesirable turbulence as stream 150 separates from spline 140. Generally, length $L_s$ of splitter 136 is dependent on blower 100 design and is pre-determined to maximize the advantages obtained by uniformly distributing stream 150 and to minimize the growth of the boundary layer on spline member 140. More specifically, splitter length $L_s$ is configured to evenly distribute air stream 150 while preventing boundary layer growth on spline member 140 of splitter 136.

As shown in FIG. 7, splitter 136 is coupled to scroll wall 126 between first and second sidewalls 114 and 122. In the exemplary embodiment, splitter 136 is coupled an equal distance from each of sidewall 114 and 122. Alternatively, splitter 136 may be offset along wall 126 such that splitter 136 is positioned nearer to sidewall 114 or sidewall 122. Generally, splitter 136 is positioned between sidewalls 114 and 122 such that the flow of stream 150 is evenly distributed to prevent recirculation as described herein. Moreover, in the exemplary embodiment, splitter 136 is positioned such that spline member 140 is a constant distance from sidewalls 114 and 122. Alternatively, spline member 140 may be curved such that spline 140 curves toward one of sidewalls 114 or 122. Further, spline member 140 has a pre-determined height H that varies over length $L_s$ of splitter 136. More specifically, in the exemplary embodiment, spline member 140 includes opposing ends 139 and 141 which form a crescent-shape such that ends 139 and 141 gradually slope towards scroll wall 126. Alternatively, ends 139 and 141 may be perpendicular to scroll wall 126. Generally, ends 139 and 141 may be any shape or create any angle with respect to scroll wall 126 that facilitates operation of blower assembly 100 as described herein. Also, spline member 140 has a thickness that is constant over both the entire height H and entire length $L_s$ of splitter 136. Alternatively, the splitter 136 thickness may vary over either or both splitter height H and splitter length $L_s$. Generally, spline 140 is shaped such that the flow of stream 150 is evenly distributed to prevent recirculation as described herein.

Spline member 140 also includes a side surface 160 and splitter base 142 includes a top surface 162. In the exemplary embodiment, surfaces 160 and 162 are hydraulically smooth such that any protuberances on surfaces 160 and 162 are smaller than the thickness of a laminar boundary layer immediately adjacent surfaces 160 and 162. Hydraulically smooth surfaces 160 and 162 are configured to prevent formation of a turbulent boundary layer along splitter 136. In the exemplary embodiment, splitter 136 is comprised of a metallic material. Alternatively, splitter 136 may be comprised of a plastic material. Generally, splitter 136 is comprised of any material that enables splitter 136 to function as described herein.

In the exemplary embodiment, blower assembly 100 further includes baffle 138 having horizontal and vertical members 144 and 146 that cooperate to define a plurality of openings 148 as described above. Baffle 138 is configured to straighten stream 150 as it passes through outlet 132 into a downstream conditioning component, such as a duct 164. Duct 164 includes opposing first and second sidewalls 166 and 168 that are configured to channel second stream 150 downstream from blower 100. In the exemplary embodiment, baffle 138 is configured to redirect stream 150 to create a uniformly distributed stream 152 that is substantially parallel to sidewalls 166 and 168.

In the exemplary embodiment, baffle 138 is positioned within outlet 132 and adjacent cut-off 134 such that baffle 138 captures a majority of stream 150 before stream 150 recirculates into chamber 130. Baffle 138 includes a length $L_B$ that extends between a first end face 170 and a second end face 172. In the exemplary embodiment, both first and second end faces 170 and 172 are perpendicular to duct sidewalls 166 and 168 so as to define a substantially rectangular baffle 138 that has a constant length $L_B$. Alternatively, either or both first and second end faces 170 and 172 may be curved such that at least a portion of baffle 138 has an at least partially elliptical cross section. Specifically, first end face 170 may be curved such that a portion of baffle 138 extends beyond cut-off 134 to facilitate capturing a substantial portion of air stream 150 and channeling it though openings 148 of baffle 138.

As air stream 150 approaches baffle 138, stream 150 is traveling in a circumferential direction, which may reduce blower 100 efficiency and produce noise if left untreated, as described above with respect to FIGS. 2 and 3. In the exemplary embodiment, baffle 138 is configured to capture a substantial portion of stream 150 and to turn, or straighten, stream 150 as it flows through baffle 138 such that stream 150 is straightened before exiting baffle 138 through outlet 132. Upon exiting blower 100, first air stream 150 transitions to second air stream 152 within a downstream conditioning component, such as duct 164. In the exemplary embodiment, baffle 138 straightens stream 150 such that stream 152 flows in a direction parallel to sidewalls 166 and 168 of duct 164. As such, baffle 138 directs stream 150 as it exits blower 100 to prevent stream 152 from impacting sidewalls 166 and 168, which prevents the formation of eddies within duct 164 to improve blower 100 efficiency and reduce noise generation.

Baffle 138 is of a length $L_B$ that is long enough to straighten air stream 150 prior to stream 150 exiting blower 100, but not so long such that the size of the boundary layers formed on baffle members 144 and 146 increases. Growth of a boundary layer on baffle members 144 and 146 increases the viscosity of stream 150 and may cause undesirable turbulence within baffle 138 as stream 150 separates from baffle members 144 and 146. Baffle 138 is of sufficient length $L_B$ to turn and straighten stream 150 and also prevent growth of a boundary layer on baffle member 144 and 146. Generally, the higher the velocity of stream 150 generated by blower 100 at outlet 132, the greater the non-uniformity (formation of eddies) within duct 164, so the longer baffle length $L_B$ required to turn stream 150. As such, baffle 138 has a pre-determined length $L_B$ based on the velocity of stream 150 as determined by blower 100 design.

In the exemplary embodiment, baffle 138 covers substantially all of outlet 132 such that substantially all of stream 150 passes through baffle openings 148 before exiting blower 100. Baffle 138 and baffle members 144 and 146 are configured to define the plurality of openings 148 such that each opening comprises approximately 10% of the outlet area. Alternatively, each opening 148 may comprise any percentage of the outlet area. In the exemplary embodiment, baffle 138 defines nine openings 148. Alternatively, baffle 138 may define any number of openings 148 that enable blower 100 to operate as described herein. The straightening and even distribution of stream 150 by baffle 138 facilitates a reduction in downstream turbulence and creates a uniform airflow distribution at blower outlet 132, which leads to more efficient blower 100 operation and a reduction in noise generation.

Figure 9:
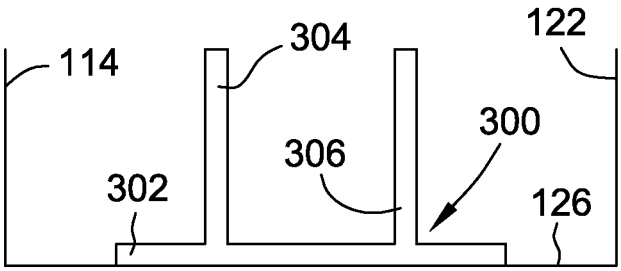
FIG. 9 is a cross-sectional view of an alternative embodiment of an air stream splitter.
Figure 10:
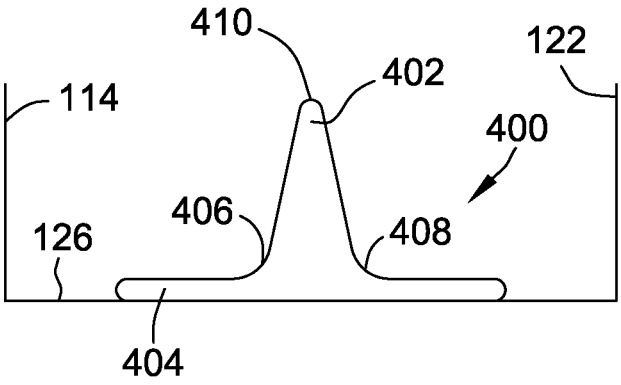
FIG. 10 is a cross-sectional view of another alternative embodiment of an air stream splitter.

FIGS. 9 and 10 illustrate alternative embodiments of an air stream splitter that may be used in blower 100. Like components will be given like reference numerals for ease of understanding. FIG. 9 is a cross-sectional view of an alternative air stream splitter 300. Splitter 300 includes a base portion 302, a first spline member 304, and a second spline member 306. Base portion 302 is coupled to scroll wall 126 of blower 100. Alternatively, splitter 300 may include only first and second spline members 304 and 306 that extend perpendicularly a varying distance from scroll wall 126. Although splitter 300 is illustrated as having two spline members 304 and 306, splitter 300 may include any number of spline members for blower assembly 100 to operate as described herein. Splitter 300 is positioned between sidewalls 114 and 122 as described above with respect to splitter 136. Splitter 300 is configured to evenly distribute stream 150 within blower chamber 130 to prevent recirculation. Moreover, splitter 300 may be used in a blower having more than one inlet. FIG. 10 is a cross-sectional view of yet another alternative splitter 400. Splitter 400 includes a base portion 404 and a spline member 402 similar to base 142 and spline 140 of splitter 136. Splitter 400 also includes rounded joints 406 and 408 where spline member 402 is coupled to base portion 404. When spline 402 is coupled directly to scroll wall 126, joints 406 and 408 are rounded between spline 402 and wall 126. Moreover, spline member 402 includes a rounded distal end 410. Rounded joints 406 and 408 and distal end 410 further facilitate evenly distributing stream 150 to prevent recirculation. Although blower assembly 100 is illustrated as having only one inlet, outlet, and wheel, blower assembly 100 may include any number of inlets, outlets, and wheels.

The exemplary embodiments of a centrifugal blower assembly described herein facilitate providing a more uniform distribution of airflow within the blower assembly to increase blower efficiency and decrease noise generation. Generally, optimization of the shape and placement of the air stream splitter and baffle element depends on many factors, such as the size of the blower housing and the volume and velocity of air passing through the housing. Specifically, an air stream splitter is coupled at a pre-determined location within a blower chamber such that the air stream splitter is configured to prevent air flow recirculation within the blower assembly. The air stream splitter includes a crescent-shaped spline member that splits recirculating air within the blower chamber to increase the efficiency of the blower assembly. Furthermore, a baffle element is positioned with the blower chamber and adjacent a blower outlet such that the baffle element is configured to facilitate uniform distribution of airflow downstream of the blower assembly. Specifically, the baffle element receives circumferentially moving airflow at a first end face and turns the airflow such that a straightened, uniformly distributed, airflow is exhausted from the baffle's second end face. Straightening the airflow prevents the airflow from impacting a downstream component and generating noise.

Exemplary embodiments of a centrifugal blower assembly and a method for assembling the same are described above in detail. The methods and assembly are not limited to the specific embodiments described herein, but rather, components of the assembly and/or steps of the methods may be utilized independently and separately from other components and/or steps described herein. For example, the methods may also be used in combination with other air stream distribution systems and methods, and are not limited to practice with only the assembly and methods as described herein. Rather, the exemplary embodiment can be implemented and utilized in connection with many other air stream distribution applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A centrifugal blower assembly comprising:

a scroll wall and at least one sidewall, said scroll wall coupled to said at least one sidewall such that said scroll wall and said at least one sidewall at least partially define a blower chamber and a blower outlet, wherein said scroll wall is oriented perpendicular to said at least one sidewall; and an air stream splitter coupled to said scroll wall and positioned entirely within said blower chamber, said air stream splitter comprising:

a spline member extending a varying distance from said scroll wall, wherein said spline member is oriented perpendicular to said scroll wall and parallel to said at least one sidewall; and a base member fixedly coupled to said scroll wall such that an outermost surface of said base member contacts said scroll wall and is positioned within said blower chamber, said base member comprising a curved plate, wherein said spline member extends perpendicularly from said curved plate, wherein said outermost surface of said base member comprises an outermost surface of said air stream splitter.

2. The centrifugal blower assembly in accordance with claim 1, wherein said air stream splitter extends along one quarter of a circumference of the blower assembly.

3. The centrifugal blower assembly in accordance with claim 1, wherein said air stream splitter is integrally formed with said scroll wall.

4. The centrifugal blower assembly in accordance with claim 1, wherein said spline member comprises a pair of opposing ends, and wherein said spline member is crescent-shaped such that said pair of opposing ends gradually slope toward the scroll wall.

5. The centrifugal blower assembly in accordance with claim 1, wherein a thickness of said spline member is constant over an entire height and an entire length of said spline member.

6. The centrifugal blower assembly in accordance with claim 1, further comprising a baffle coupled to said scroll wall, wherein said baffle element includes at least one horizontal member and at least one vertical member defining a plurality of openings.

7. The centrifugal blower assembly in accordance with claim 6, wherein said baffle element is positioned within said blower outlet and adjacent a cut-off point.

8. The centrifugal blower assembly in accordance with claim 6, wherein said baffle element covers all of said blower outlet.

9. The centrifugal blower assembly in accordance with claim 6, wherein said baffle element includes a length that extends between a first end face and a second end face.

10. The centrifugal blower assembly in accordance with claim 1, wherein said base member comprises a first curved surface coupled to said scroll wall and a second curved surface spaced from said first curved surface.

11. The centrifugal blower assembly in accordance with claim 1, wherein said outermost surface of said base member is continuous between a first side of said base member and a second side of said base member.

12. A centrifugal blower assembly comprising:

a scroll wall at least partially defining a blower chamber;

a base member fixedly coupled to said scroll wall such that said base member is positioned entirely within said blower chamber, at least partially defines said blower chamber and is oriented parallel to said scroll wall, said base member including a curved shape that conforms to a curved shape of said scroll wall, said base member comprising a first curved surface coupled to said scroll wall and a second curved surface spaced from said first curved surface, wherein said first curved surface comprises an outermost surface of said base member; and a spline member oriented perpendicular to said second curved surface and said scroll wall.

13. The centrifugal blower assembly in accordance with claim 12 comprising an air stream splitter comprising said spline member, wherein said airstream splitter is coupled to said scroll wall.

14. The centrifugal blower assembly in accordance with claim 12, wherein said spline member includes a height and a length, wherein the spline height varies along the spline length.

15. The centrifugal blower assembly in accordance with claim 12, further comprising a baffle coupled to said scroll wall, wherein said baffle element comprises at least one first member and at least one second member, said at least one first member oriented perpendicular to said at least one second member.

16. The centrifugal blower assembly in accordance with claim 15, wherein said at least one first member and said at least one second member define a plurality of openings.

17. A centrifugal blower assembly comprising:

a scroll wall and at least one sidewall, said scroll wall extending from said at least one sidewall such that said scroll wall and said at least one sidewall at least partially define a blower chamber and a blower outlet, wherein said scroll wall is oriented perpendicular to said at least one sidewall; and an air stream splitter coupled to said scroll wall and positioned entirely within the blower chamber, said air stream splitter comprising:

a spline member extending a varying distance from said scroll wall, wherein said spline member is oriented perpendicular to said scroll wall and parallel to said at least one sidewall, said spline member comprising a first spline end, an opposing second spline end, and a distal edge extending from said first spline end to said second spline end, wherein said distal edge comprises a continuous curvature; and a base member fixedly coupled to said scroll wall such that an outermost surface of said base member contacts said scroll wall and is positioned within said blower chamber, said base member comprising a curved plate, wherein said spline member extends perpendicularly from said curved plate, said base member comprising a first base end coterminous with said first spline end and a second base end coterminous with said second spline end, wherein said outermost surface of said base member comprises an outermost surface of said air stream splitter.

18. A centrifugal blower assembly comprising:

a scroll wall including an inner surface at least partially defining a blower chamber;

a base member fixedly attached to said inner surface such that said base member contacts said inner surface and is entirely positioned within said blower chamber, said base member comprising a first curved surface coupled to said scroll wall and a second curved surface extending parallel to said first curved surface, wherein said first curved surface comprises an outermost surface of said base member; and a spline member extending perpendicularly from said second curved surface.

19. A blower housing for use with a centrifugal blower assembly, said blower housing comprising:

a scroll wall and at least one sidewall, said scroll wall coupled to said at least one sidewall such that said scroll wall and said at least one sidewall at least partially define a blower chamber and a blower outlet, wherein said scroll wall is oriented perpendicular to said at least one sidewall;

an air stream splitter coupled to said scroll wall and positioned entirely within the blower chamber, said air stream splitter comprising:

a spline member extending a varying distance from said scroll wall, wherein said spline member is oriented perpendicular to said scroll wall and oriented parallel to said at least one sidewall; and a base member fixedly coupled to said scroll wall such that said base member extends from said scroll wall into said blower housing, said base member comprising a curved plate, wherein said spline member contacts said curved plate, wherein an outermost surface of said base member contacts said scroll wall and is positioned within said blower chamber, wherein said outermost surface of said base member comprises an outermost surface of said air stream splitter.

20. The blower housing in accordance with claim 19, wherein, said spline member comprises a first spline end and an opposing second spline end, and said base member comprises a first base end coterminous with said first spline end and a second base end coterminous with said second spline end.

* * * * *